US011879324B2

(12) United States Patent
Loh et al.

(10) Patent No.: US 11,879,324 B2
(45) Date of Patent: Jan. 23, 2024

(54) TOP SIDE COUPLING GAUGE MANDREL

(71) Applicant: Baker Hughes Oilfield Operations LLC, Houston, TX (US)

(72) Inventors: Yuh Loh, Cypress, TX (US); John Raggio, Spring, TX (US); Lorn Rendall, Houston, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 80 days.

(21) Appl. No.: 17/552,382

(22) Filed: Dec. 16, 2021

(65) Prior Publication Data

US 2022/0186610 A1 Jun. 16, 2022

Related U.S. Application Data

(63) Continuation-in-part of application No. 17/124,400, filed on Dec. 16, 2020, now Pat. No. 11,506,046.

(51) Int. Cl.
*E21B 47/01* (2012.01)
*E21B 47/017* (2012.01)
*E21B 47/12* (2012.01)

(52) U.S. Cl.
CPC ..... *E21B 47/01* (2013.01); *E21B 47/017* (2020.05); *E21B 47/12* (2013.01)

(58) Field of Classification Search
CPC ..... E21B 47/01; E21B 47/017; E21B 47/12
See application file for complete search history.

(56) References Cited

U.S. PATENT DOCUMENTS

| | | | | |
|---|---|---|---|---|
| 4,570,481 | A * | 2/1986 | McLaurin | E21B 49/08 73/152.52 |
| 5,126,564 | A | 6/1992 | Perry et al. | |
| 10,280,735 | B2 | 5/2019 | Finke et al. | |
| 11,506,046 | B2 * | 11/2022 | Loh | E21B 17/028 |
| 2004/0216872 | A1 * | 11/2004 | Foster | G01V 11/005 166/380 |
| 2004/0251048 | A1 * | 12/2004 | Kurkoski | E21B 47/01 175/41 |
| 2013/0105222 | A1 | 5/2013 | Pate | |
| 2015/0226053 | A1 | 8/2015 | Mueller et al. | |
| 2017/0268326 | A1 | 9/2017 | Schlumberger | |
| 2019/0345779 | A1 * | 11/2019 | Kennedy | E21B 29/00 |
| 2021/0270125 | A1 * | 9/2021 | Smith | E21B 47/08 |

OTHER PUBLICATIONS

International Search Report and Written Opinion dated Apr. 14, 2022 in Application No. PCT/US2021/063658, 11 Pages.

* cited by examiner

*Primary Examiner* — Brad Harcourt
(74) *Attorney, Agent, or Firm* — Sprinkle IP Law Group

(57) ABSTRACT

A compact instrumented downhole coupling that includes a carrier and a set of sensors and electronics that are installed within the carrier. The carrier is a tubular structure having couplings at each end and a bore therethrough, where cavities are formed in the carrier wall. The cavities are open to a side facing away from the carrier's bore, where sensors placed in the cavities are accessible through the side opening. Electrical connections to the sensors are made via the side opening, and a clamp can be installed in the cavities via the side opening, the clamp holding the sensors securely in position within the cavities. After installation of the sensors in the cavities, plates are welded over the side opening to form an enclosure for the sensors in the carrier wall.

16 Claims, 12 Drawing Sheets

TOP SIDE COUPLING GAUGE MANDREL

RELATED APPLICATIONS

This application is a continuation-in-part of and claims priority to U.S. patent application Ser. No. 17/124,400, entitled "Instrumented Coupling Electronics", filed Dec. 16, 2020, which is fully incorporated herein by reference for all purposes.

BACKGROUND

Field of the Invention

The invention relates generally to electronic equipment, and more particularly to instrumented couplings that are configured to be installed downhole in wells.

Related Art

It is often desirable to use electronic sensors to make measurements of conditions within a well. These sensors may be installed on in-line carriers that are connected to production tubing or other pieces of downhole equipment that are positioned within the well. Traditionally, the carriers are constructed by forming a mandrel that has couplings on each end and a bore therethrough so that it can be connected in line with the tubing and/or equipment. A single narrow groove is milled into the exterior surface of the mandrel from one end to the other to accommodate an elongated sensor package. The sensor package is then mounted within this pocket. If it is desired to provide multiple sensors, the pocket on the exterior of the mandrel is made large enough to accommodate each of the sensor packages (which are typically mounted side-by-side within the pocket).

There are a number of disadvantages to the conventional construction of these gauge packages. For example, a typical gauge package may be several feet long, and may therefore require a substantial amount of material to form the mandrel, which incurs substantial cost. Additionally, each of the individual sensor packages that is installed on the exterior of the mandrel normally requires its own tubular housing which provides a substantially sealed enclosure that contains the sensor and electronic components (the cavities may be sealed except that they may be in fluid communication with the bore of the carrier or the annulus between the exterior of the carrier and the well bore). This housing may also provide some protection for these components, as the sensor package is installed in a somewhat exposed location on the exterior of the mandrel and may therefore be subject to damage as the gauge package is installed or used in the well. Another disadvantage is that, if the sensor is intended to measure conditions within the bore of the mandrel, a port is normally drilled from the exterior pocket to the bore at the interior of the mandrel, and a manifold at the end of the housing of the sensor package must be mounted over this port and sealed.

One carrier that improves on this traditional design is an instrumented coupling as disclosed in U.S. patent application Ser. No. 17/124,400, which is incorporated by reference herein. This improved instrumented coupling uses a carrier which serves not only as a coupling, but also as a housing for sensors and associated electronics that are installed in pockets or cavities within the carrier wall. The carrier is a tubular structure having couplings at each end and a bore extending through the carrier from the first end to the second end, forming a carrier wall between the bore and the exterior surface of the carrier. The bore and couplings are offset from a central axis of the carrier (the axis of the cylindrical outer surface of the carrier), resulting in a thicker portion of the carrier wall on one side of the carrier. Cavities are formed within the thicker portion of the carrier wall by gun drilling holes in the wall. Sensors and corresponding electronics are then positioned within the cavities, so that the carrier wall itself forms a housing for the sensors and electronics.

Although this improves on previous designs, this design has a number of disadvantages of its own. For example, the gun drilling process requires very high precision and is very costly. Because of the high precision that is required, there is an increased risk that the errors and inaccuracies in the manufacturing of the carrier will result in the carrier being scrapped. Additionally, because the sensors and electronics have to be inserted into the small openings of the gun drilled holes, installation, soldering and splicing that must be done to connect the sensors and electronics during the installation can be very difficult, requiring more time, labor and associated cost. Further, the sensors and electronics cannot be easily secured within the gun drilled holes, so these components are subject to damage resulting from movement of the components within the holes. Still further, enclosing the sensors and associated electronics within the gun drilled holes may require complicated weld profiles which increase the time and cost to manufacture the coupling.

It would therefore be desirable to provide an improved gauge package that reduces or eliminates one or more of the disadvantages of earlier designs.

SUMMARY OF THE INVENTION

This disclosure is directed to systems and methods for providing instrumented couplings that carry corresponding downhole sensors. The improved instrumented coupling uses a carrier which serves not only as a coupling, but also as a housing for sensors and associated electronics that are installed in the carrier. pockets or cavities within the carrier wall. The carrier may have an offset bore, so that the carrier wall is thicker on one side, allowing larger cavities to be provided for the sensors and electronics.

One embodiment comprises an instrumented downhole coupling that includes a carrier and a set of sensors and electronics that are installed within the carrier. The carrier is a tubular structure having a first coupling at a first end and a second coupling at the opposite end. A bore extends through the carrier from the first end to the second end, forming a carrier wall between the bore and the exterior surface of the carrier. The bore is offset from a central axis of the carrier (the axis of the cylindrical outer surface of the carrier), creating an increased-thickness portion of the carrier wall on a first side of the carrier. A sensor cavity is formed within the increased-thickness portion of the carrier wall (e.g., by machining the cavity into the wall), where the cavity has a side opening that faces away from the central axis of the carrier. One or more sensors are positioned within the cavity and electrical connections between the sensors and corresponding electronics and/or power/communication cables are made. The sensors may include, for example, a tubing sensing gauge, an annulus sensing gauge, etc. The sensors may be secured within the cavity by a clamp that holds them in position. After the sensors are secured in the cavity, protective plates are welded into place over the side-facing opening to seal the opening. This forms a sealed enclosure around the sensors in the cavity, except that the cavities may be in fluid communication with the bore of the coupling or the annulus between the coupling and the well bore. The coupling thereby prevents fluids at the bore and the exterior of the carrier from reaching the cavities containing the sensors and the electronics packages.

The cavity within the carrier wall may be sized to accommodate one or more sensors positioned at circumferentially displaced locations around the carrier, typically with the elongated sensors side-by-side within the carrier wall. The carrier may therefore be shorter than a conventional carrier in which the components of each sensor assembly (e.g., sensor, electronics, manifold) are positioned end-to-end in a tubular housing (see FIG. 1, discussed below). Since the carrier itself serves as the sensor housing, the material of the conventional sensor housing can be eliminated, and the overall amount of material which is required for the coupling (carrier and sensor packages) is reduced. In relation to existing carriers having gun drilled cavities, the size and amount of material used is comparable, but the present embodiments can be manufactured at significantly less cost. The reduced cost may result from a number of different factors, such as the elimination of gun drilling, which is a costly process and increases the risk of having to scrap carriers due to problems during their manufacture. Since the sensor cavities in the present embodiments are open to the side and are open along the entire length of the cavities, there is much greater access to the sensors in the cavities for installation, soldering and splicing of wires, which reduces the time and labor required to manufacture the couplings. Further, the open side access to the cavities enables the use of a clamp to secure the sensors in the cavities, which reduces the vibration and shock to the sensors and increases their reliability. Still further, the weld profiles on the present embodiments are less complicated than those for previous carriers having gun drilled cavities, which reduces the time and labor requirements.

In some embodiments, one of the sensor cavities includes a port through which the interior of the cavity is in fluid communication with the exterior of the carrier (hence the annulus between the carrier and the well bore). One of the cavities may have a port through which the interior of this cavity is in fluid communication with the bore that extends through the carrier. Another one of the cavities may be configured to enable a feed-through electrical cable to be installed to pass through the carrier, or to extend from the exterior of the carrier into one or more of the cavities within the carrier wall, where it can be connected to the corresponding sensor.

One alternative embodiment may include a method for manufacturing instrumented downhole couplings as described above. Another alternative embodiment may comprise a carrier as described above which is configured to serve as a coupling and to provide an enclosure for sensors and associated electronics within the carrier wall. Numerous other embodiments are also possible.

BRIEF DESCRIPTION OF THE DRAWINGS

Other objects and advantages of the invention may become apparent upon reading the following detailed description and upon reference to the accompanying drawings.

Figure 1:
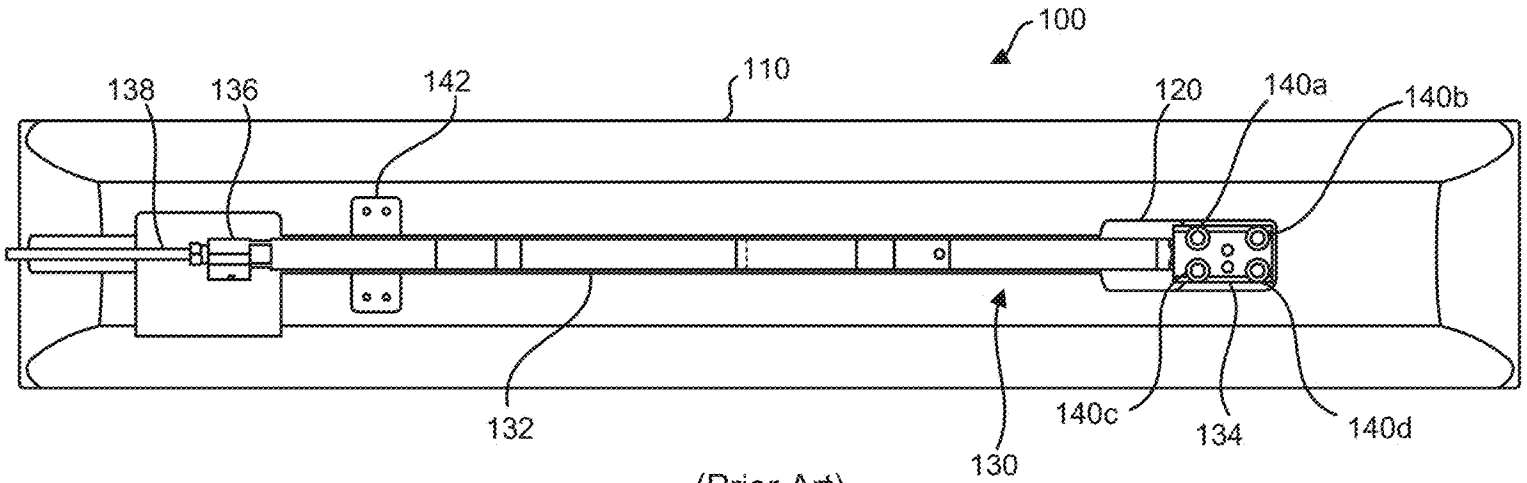
(Prior Art) FIG. 1
FIG. 1 is a diagram illustrating a conventional gauge package in accordance with the prior art.

While the invention is subject to various modifications and alternative forms, specific embodiments thereof are shown by way of example in the drawings and the accompanying detailed description. It should be understood, however, that the drawings and detailed description are not intended to limit the invention to the particular embodiment which is described. This disclosure is instead intended to cover all modifications, equivalents and alternatives falling within the scope of the present invention as described herein. Further, the drawings may not be to scale, and may exaggerate one or more components in order to facilitate an understanding of the various features described herein.

DETAILED DESCRIPTION OF EXEMPLARY EMBODIMENTS

One or more embodiments of the invention are described below. It should be noted that these and any other embodiments described below are exemplary and are intended to be illustrative of the invention rather than limiting.

This disclosure is directed to an improved instrumented coupling or gauge package that uses a carrier which serves as a housing for sensors and associated electronics that are installed in pockets or cavities within the carrier wall. The carrier may have an offset bore, so that the carrier wall is thicker on one side, allowing larger cavities to be provided for the sensors and electronics.

Figure 2:
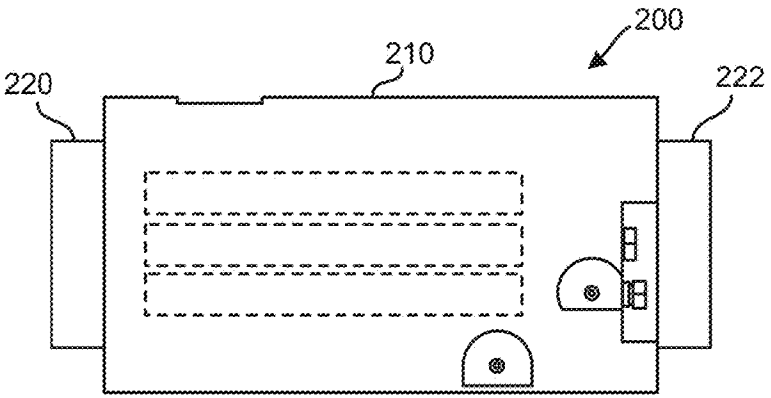
FIG. 2 is a diagram illustrating an instrumented coupling with gun drilled cavities.

Referring to FIGS. 1 and 2, diagrams illustrating differences between a conventional gauge package and a gauge package (an instrumented coupling) having gun drilled cavities are shown. As depicted in FIG. 1, the conventional gauge package 100 is constructed using an elongated tubular mandrel 110 which serves as a carrier. A coupling is formed at each end of the mandrel so that the gauge package can be connected to a pipe section, tubing, or other downhole equipment. An elongated pocket 120 is milled into the exterior of the mandrel. Pocket 120 is sized to accommodate a sensor package 130 therein. The sensor package itself has a long tubular housing 132 that encloses the sensors and associated electronics of the sensor package. In this example, sensor package 130 has a manifold 134 at one end which is mounted over a port to the bore at the interior of mandrel 110 and allows fluid communication between the sensor inside the sensor package and the bore of the mandrel. A set of bolts 140*a*-140*d* secure manifold 134 to mandrel 110. The interface between manifold 134 and mandrel 110 is sealed to prevent fluids from the exterior of the mandrel from entering the sensor package. At the other end 136 of the sensor package is a coupling which allows a cable, TEC (tubing encapsulated conductor) or other conductor 138 to be electrically connected to the electronic components within sensor package 130. A bracket 142 is provided to secure this end of sensor package 130 to mandrel 110.

Referring to FIG. 2, gauge package 200 is depicted in a scale which is substantially the same as the conventional gauge package of FIG. 1 in order to illustrate the overall size of the improved gauge package with respect to the conventional design. In this embodiment, the carrier 210 is again a tubular structure having a coupling 220, 222 on each end which enables the carrier to be connected in line to a pipe section or other equipment. A bore extends through the carrier from one coupling to the other. Rather than providing a pocket on the exterior of the carrier, as in the conventional design of FIG. 1, this embodiment has elongated cavities formed within the wall of the carrier (e.g., at positions indicated by the dashed lines) by gun drilling holes (cavities) into the wall from the end of the carrier. The sensors and corresponding electronic components are placed within these cavities. The carrier itself therefore serves as a housing for each of the sensors and corresponding electronics, so it is not necessary to manufacture a separate sensor package housing for each of the sensors and their corresponding electronics. Further, the cavities and the sensors/electronics are positioned side-by-side within the wall of the carrier, allowing the carrier to be substantially shorter than the conventional mandrel-type carrier, which holds the sensor packages as elongated, end-to-end configured assemblies.

Figure 3:
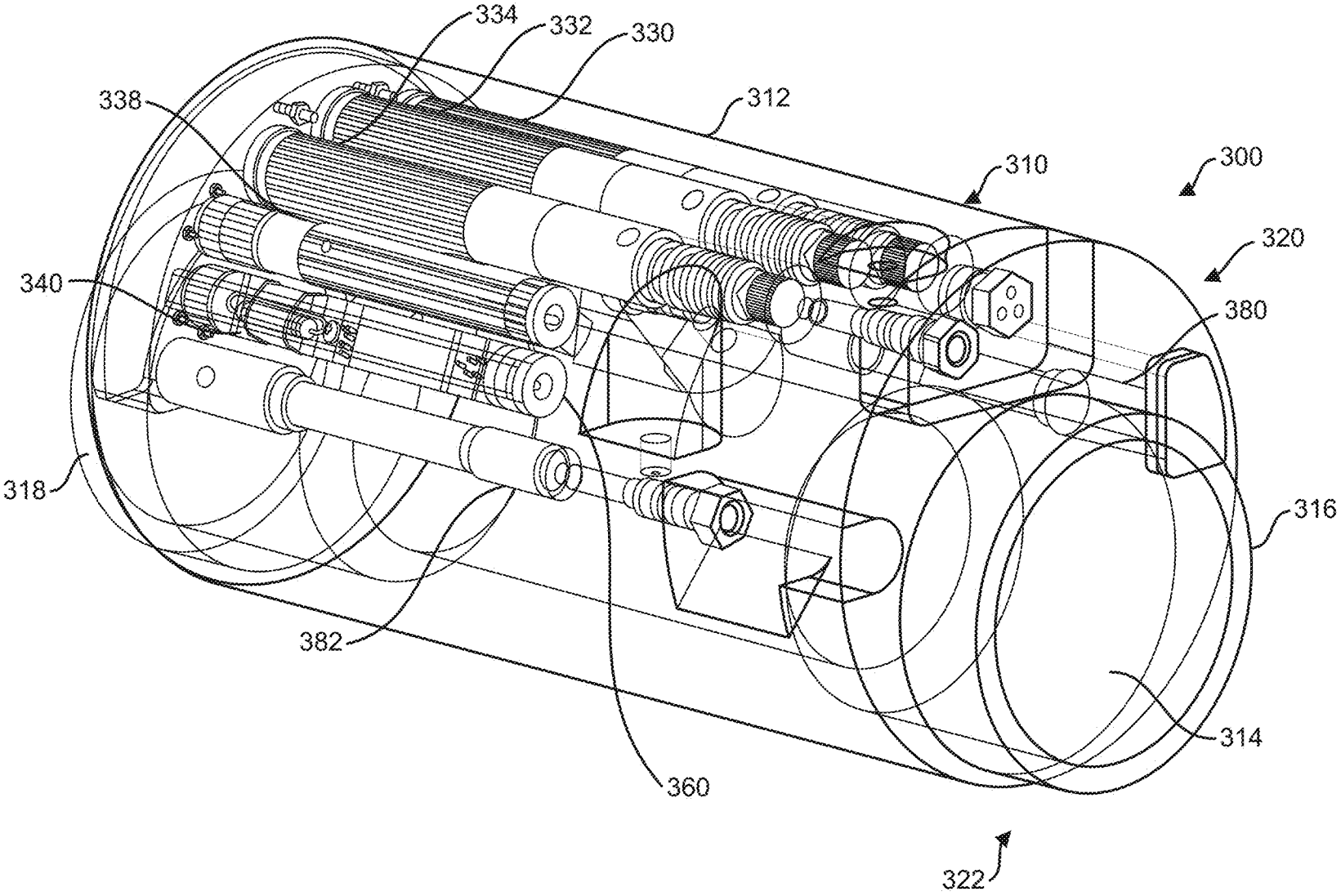
FIG. 3 is a diagram illustrating a perspective view of the components of the instrumented coupling of FIG. 2.
Figure 4:
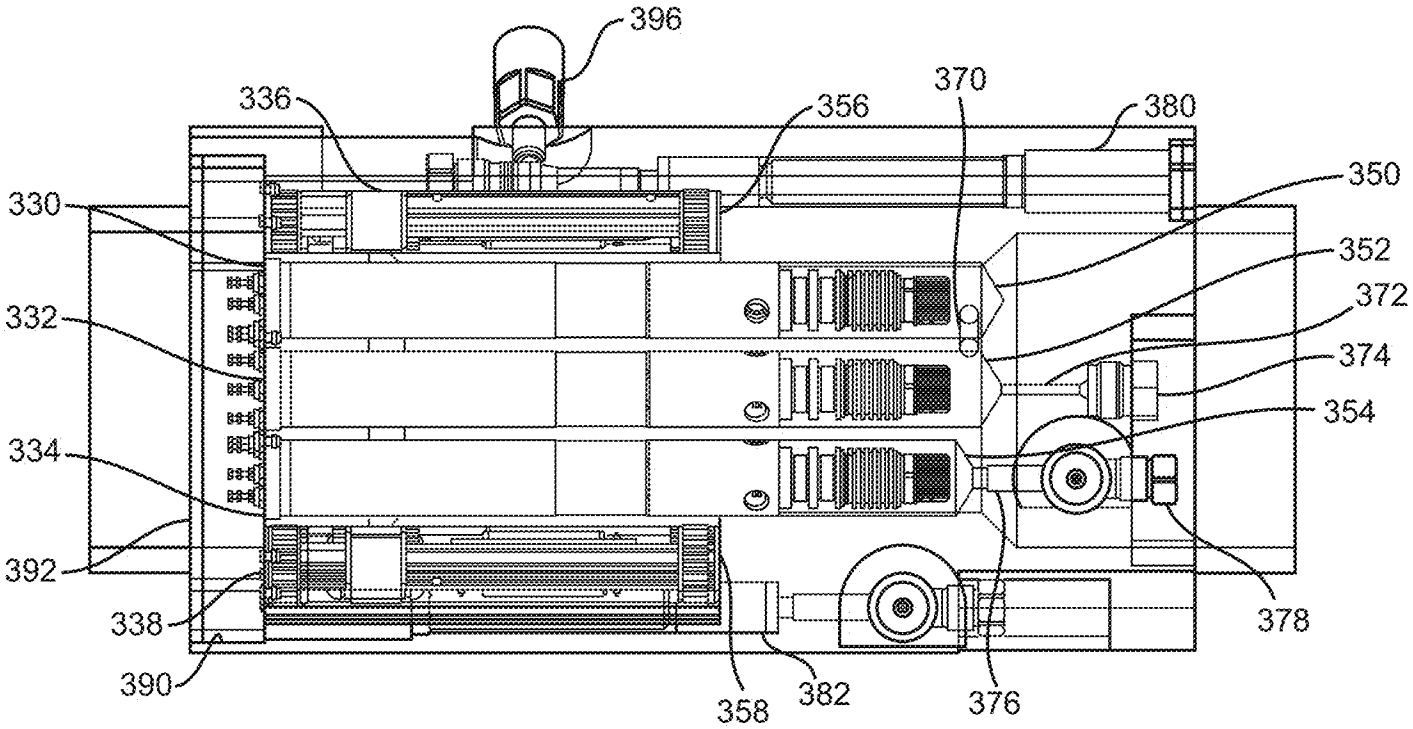
FIG. 4 is a diagram illustrating a plan view of the components of the instrumented coupling of FIG. 2.

Referring to FIGS. 3 and 4, detailed diagrams illustrating the configuration of the instrumented coupling of FIG. 2 are shown. FIG. 3 shows a perspective view of the components of the instrumented coupling, while FIG. 4 shows a plan view of the components.

Referring to FIGS. 3 and 4, instrumented coupling 300 has a set of sensors and associated electronics which are installed in a carrier 310. Carrier 310 has a generally cylindrical exterior surface 312 and has a generally cylindrical bore 314 therethrough. A coupling (316, 318) is provided at each end of bore 314 to enable the gauge package to be connected inline with other downhole equipment (e.g., pipe sections). Couplings 316 and 318 may, for example be internally threaded couplings that are configured to be connected to externally threaded adjacent components. In one embodiment, the carrier is a unitary component which is formed by machining the carrier out of a single, solid piece of metal.

Bore 314 is not coaxial with exterior surface 312, but is instead offset so that the wall of the carrier which is formed between the bore and the exterior surface has a first portion 320 on one side of the bore which is thicker than a second portion 322 on the opposite side of the bore. As depicted in FIG. 3, the axis of cylindrical bore 314 is below the axis of cylindrical exterior surface 312, so that the first, thicker portion 320 is at the top of the gauge package, and the second, thinner portion 322 is at the bottom of the gauge package.

Bore 314 is offset in order to provide sufficient thickness in first wall portion 320 to allow holes to be gun drilled into the thickened wall portion from the end of the carrier. These holes accommodate one or more elongated sensors and their associated electronics. In the example of FIGS. 3 and 4, three holes are drilled to accommodate sensors and three holes are drilled to accommodate three sets of electronics corresponding to the three sensors.

In this example, the sensors are inserted into the open ends of the holes that are gun drilled into the thickened wall of the carrier. Thus, the carrier wall serves as the housing for each of the sensors, eliminating the need to provide the tubular housing that would be secured to the exterior of the carrier in a conventional design. This eliminates the need for the material and cost associated with manufacturing the separate housing for the "housingless" sensors and reduces the cost of the gauge package with respect to conventional designs. The electronics associated with each of the sensors are likewise installed in holes that are gun drilled into the wall of carrier 310, so that the carrier wall serves as the housing for the electronics as well.

In the example of FIGS. 3 and 4, sensor 330 is installed in hole 350, sensor 332 is installed in hole 352, and sensor 334 is installed in hole 354. Likewise, electronics 336 are installed in hole 356, electronics 338 are installed in hole 358, and electronics 340 are installed in hole 360. It is common for gauge packages to use from one to three sensors (with associated electronics) in a gauge package. A pair of cable feedthroughs 380 and 382 are also provided in carrier 310 to allow cables or other conductors to be installed in the carrier. The sensors and/or electronics are coupled to the cables/conductors to provide power to and/or enable communication with the sensors and/or electronics.

In some embodiments, a carrier such as is depicted in FIGS. 3 and 4 is manufactured as a standardized design having gun drilled holes into which one, two, or three sensors and their associated electronics can be installed. The desired sensors can be installed in corresponding pockets of an identical carrier while one or more of the pockets may simply be left empty. This use of a standardized carrier design can provide manufacturing efficiencies that are not found in conventional approaches in which a groove is custom-milled into the surface of a mandrel to accommodate a specific number of sensor packages.

The specific gun drilled holes into which the sensor(s) is/are installed may depend upon the purpose of the sensor(s). For example, a sensor for monitoring conditions within the bore of the carrier would be installed in one of the holes that is in fluid communication with the bore, while a sensor for monitoring conditions in the annulus of the well would be installed in one of the holes that is include communication with the exterior of the carrier. In the embodiment of FIGS. 3 and 4, a small conduit 370 connects hole 350 to the bore 314 of carrier 310 to enable fluid communication between the pocket and the bore. Another small conduit 372 provides a port from hole 352 to the exterior of carrier 310 so that sensor installed in the hole can be in fluid communication with the annulus at the exterior of the carrier. A valve 374 may be provided to selectively enable fluid communication between hole 352 and the annulus at the exterior of the carrier. A conduit 376 may be provided between hole 354 and a connector 378 to enable fluid communication between the hole and an external conduit that can be coupled to connector 378 for remote tap sensing or other purposes.

A pressure test adapter 396 is shown in FIG. 4 connected to a pressure test port of the instrumented coupling. The pressure test adapter is not part of the instrumented coupling, but is a piece of existing test equipment that is included in the figure to show that the instrumented coupling is adapted to allow such existing test equipment to be connected to it for the purpose of pressure testing the instrumented coupling. Additional pressure test port 397 is also provided at conduit 376 to allow pressure testing of hole 354, and pressure test port 398 is provided to allow pressure testing of feedthrough 382. As indicated above, the instrumented coupling is also adapted to use existing sensor and electronics components, albeit without the conventional sensor package housing that is secured to the exterior of conventional carriers.

Figure 5A:
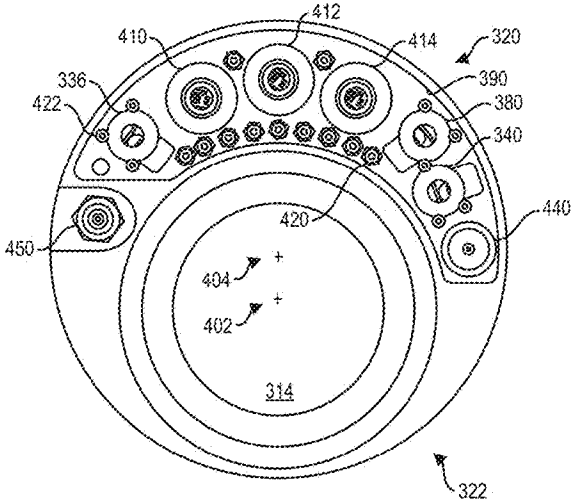
FIGS. 5A and 5B are diagrams illustrating a first end of the instrumented coupling of FIG. 2.
Figure 5B:
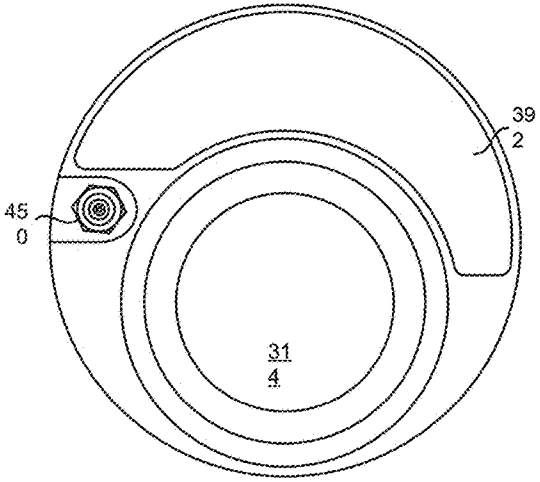
Figure 6:
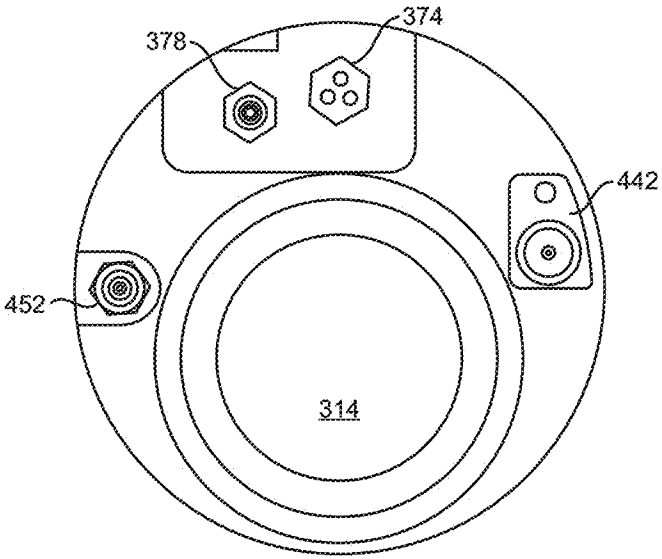
FIG. 6 is a diagram illustrating a second end of the instrumented coupling of FIG. 2.

Referring to FIGS. 5A, 5B and 6, a set of diagrams showing end views of the gun drilled instrumented coupling of FIG. 2 are shown. FIGS. 5A and 5B depict a first end of the instrumented coupling (corresponding to the left end of the instrumented coupling in FIGS. 3 and 4). FIG. 5A shows the end of the gauge package prior to installation of a compartment cover, while FIG. 5B shows the same end of the gauge package after the compartment cover has been installed. FIG. 6 shows the opposite end of the gauge package (corresponding to the right end of the gauge package as shown in FIGS. 3 and 4).

Referring to FIG. 5A, the positioning of the bore 314 with respect to the exterior of the carrier 310 is shown. In this figure, it can be more clearly seen that the axis 402 of bore 314 is offset (downward in the figure) from the axis 404 of the cylindrical carrier body. It can also be more clearly seen in this figure that the offset of the bore causes the wall of the carrier to be thinner at the bottom of the figure and thicker at the top of the figure. The thickened upper portion 320 is wide enough that the holes for the sensors and electronics can be gun drilled into the carrier wall. This figure also shows that the holes are angularly displaced from each other around the circumference of the carrier (as determined from either the axis 404 of the carrier or the axis 402 of the bore) so that the sensors and the associated electronics are positioned side-by-side (FIG. 4 shows that the sensors and associated electronics are positioned at substantially the same axial position, where "axial" is left-to-right in the figure).

Each of the holes that are drilled into carrier 310 opens to a compartment 390 at the end of the carrier. The sensors and associated electronics are inserted into the holes from the openings at compartment 390. In this embodiment, the sensors are enclosed in their respective holes by welding caps (410, 412, 414) onto the ends of the respective holes. Electrical conductors from each of the sensors extend through the caps, and these conductors may be secured to terminals or "turrets" (e.g., 420) within compartment 390. Electronics (336, 338, 340) for the sensors are inserted into the respective ones of the holes and are secured by screws (e.g., 422) conductors from the electronics extend into compartment 390, where they can be secured to the appropriate ones of terminals 420, thereby electrically connecting the electronics to the corresponding sensors. Conductors from a cable in feedthrough 382 may be electrically connected to appropriate ones of the sensors/electronics or, if the feedthrough is not used, a cover 440 may be welded onto the opening of the feedthrough into compartment 390.

Referring to FIG. 5B, After the sensors and associated electronics have been installed in the holes of the carrier and appropriate electrical connections have been made, a cover 392 is positioned at the end of the carrier to enclose compartment 390. In this embodiment, cover 392 is welded to the carrier to seal compartment 390. Feedthrough connector 450 for feedthrough 380 remains accessible at this end of the carrier after cover 392 has been welded in place over compartment 390. While cover 440 and cover 392 obstruct the end of feedthrough 382, the connector 452 for this feedthrough remains accessible at the opposite end of the carrier as shown in FIG. 6. It can also be seen in FIG. 6 that a front plate 442 is welded over the end of feedthrough 380. FIG. 6 also shows that valve 374, which is allows fluid to flow through conduit 372, and connector 378, which allows an external conduit to be coupled to cavity 354, are accessible at the end of the carrier.

Figure 7A:
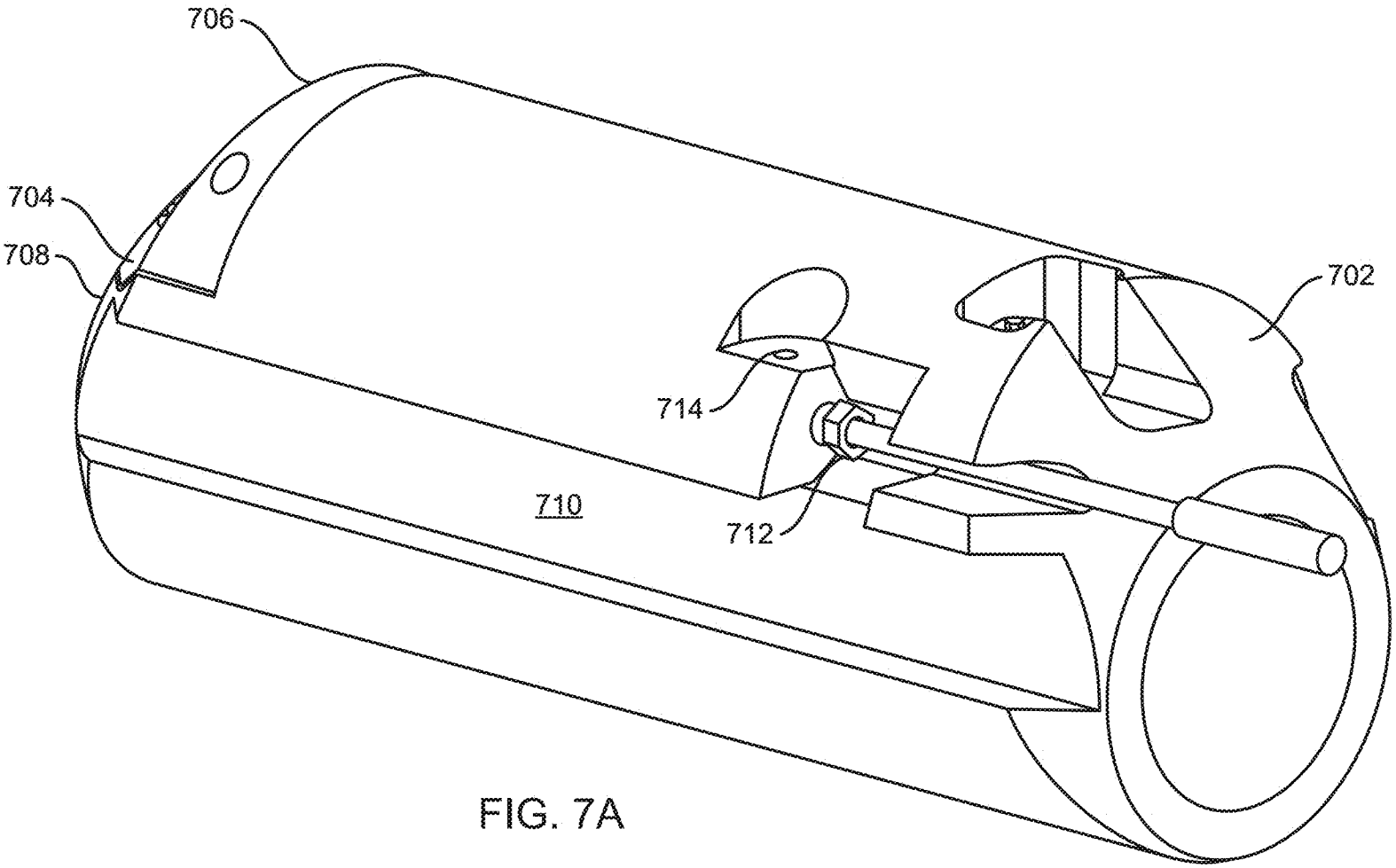
FIGS. 7A and 7B are diagrams illustrating an instrumented coupling in accordance with an alternative embodiment.
Figure 7B:
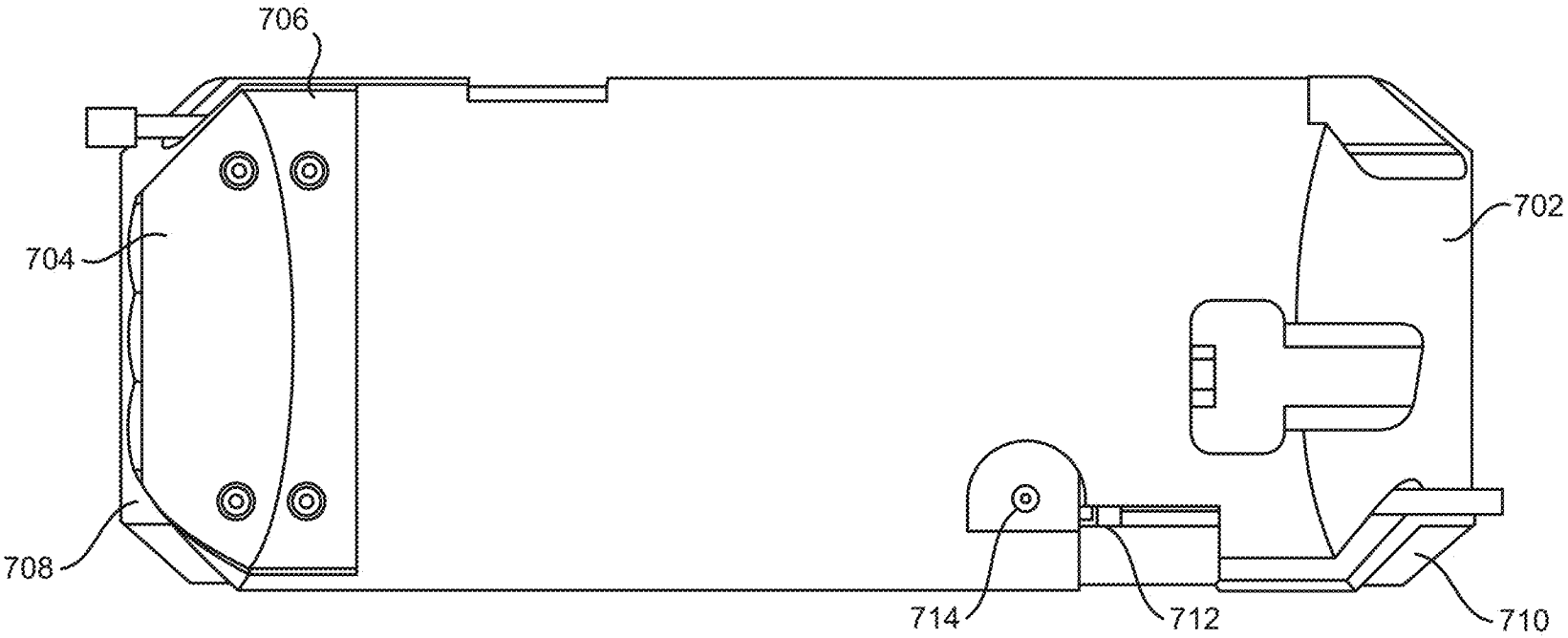

Referring to FIGS. 7A and 7B, an alternative configuration of an instrumented coupling is shown. In this figure, the configuration of the holes and other features interior to instrumented coupling 700 is substantially the same as described in connection with FIGS. 3 and 4, but the exterior configuration is somewhat different. In the embodiment of FIGS. 7A and 7B, the exterior surface at each end of the instrumented coupling is chamfered, rather than being stepped down from the smaller diameter at the ends of the apparatus to the larger diameter along the body of the carrier. At one end (on the right side of FIGS. 7A and 7B), the carrier is chamfered 702. At the other end, the chamfer 704 extends across a cover 706, as well as a part 708 of the end of the carrier. Instrumented coupling 700, like the apparatus of FIGS. 3 and 4, has a compartment at the ends of the gun drilled holes, where the compartment has a cover is welded to the carrier. Cover 706 is secured over the welded cover and serves as a bumper as well as providing chamfered surface 704.

Another feature of instrumented coupling 700 is a bypass cutout 710. Cables, TECs or the like which are connected to equipment above the instrumented coupling may extend through bypass cutout 710 to equipment below the instrumented coupling, bypassing any connection to the instrumented coupling itself. Instrumented coupling 700 also includes external features common to instrumented coupling 300, such as a feedthrough connector 712 and pressure test ports (e.g., 714)

Figure 8:
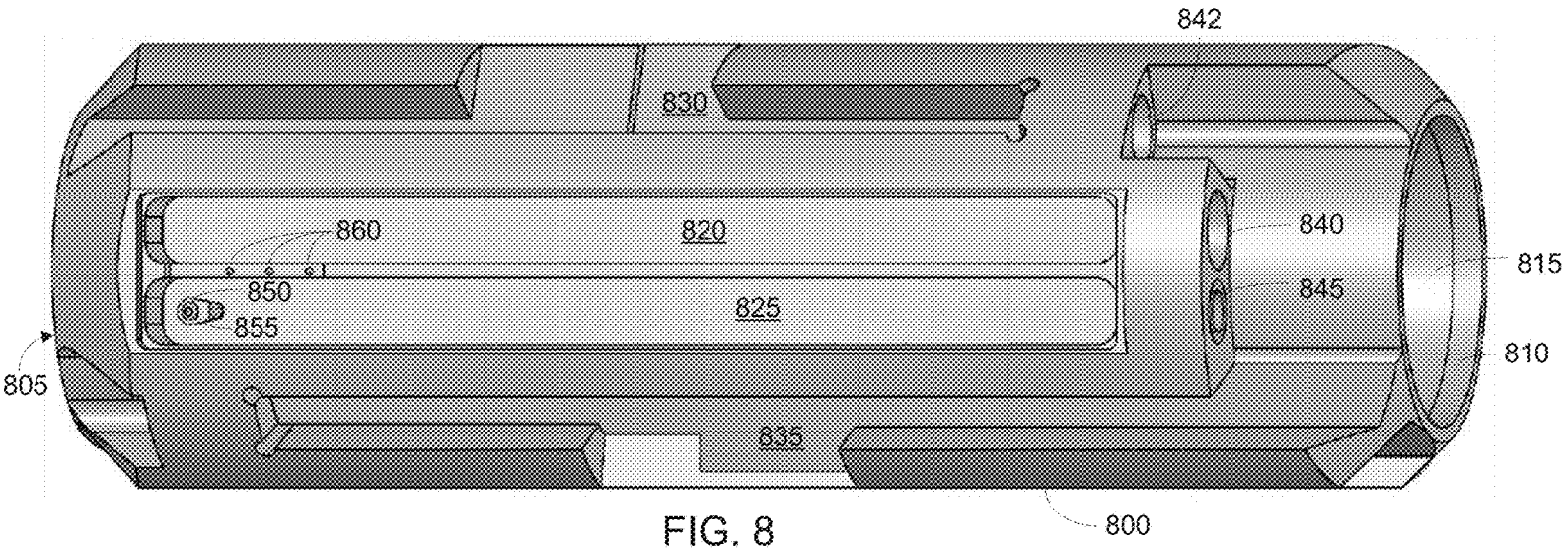
FIG. 8 is a diagram illustrating an improved carrier for a gauge package in accordance with some embodiments.

Referring to FIG. 8, a diagram illustrating an improved carrier for a gauge package in accordance with some embodiments is shown. The carrier 800 is a tubular structure having couplings 805, 810 on each end to enable the carrier to be connected between tubulars. Carrier 800 has a bore 815 therethrough so that a continuous conduit will be formed through the tubulars and the carrier. Like the carrier of FIGS. 2-7, the axis of the bore in this embodiment is offset to form a thicker portion of the carrier wall (facing out of the page) and a thinner portion (facing into the page). Cavities 820 and 825 are formed in the thicker portion of the carrier wall, but in this embodiment, the cavities or open to the side of the carrier (facing out of the page in the figure). Each of the cavities is sized to accommodate a corresponding sensor and/or corresponding electronics for the gauge package. Carrier 800 also has recesses 830 and 835 milled into the exterior of the carrier. These recesses are sized to accommodate a cable head and a feedthrough.

Since cavities 820 and 825 are open to the side of carrier 800, they can be milled into the carrier wall, rather than being gun drilled, as in the carrier of FIGS. 2-7. This allows the cavities to be formed more easily, with less cost and less waste then having to form the cavities by gun drilling holes into the carrier wall from the end of the carrier. Carrier 800 may nevertheless have holes 840 and 845 formed at the ends of cavities 820 and 825 to facilitate access to the ends of the installed sensors and/or to provide ports for fluid communication between the interior of the cavities and the exterior of the carrier after the side opening of the cavity is sealed (as will be discussed in more detail below). Similarly, holes (e.g., 842 may be provided to facilitate access to the cables that are connected to the cable head and feedthrough in recesses 830 and 835. Because the holes are short, a costly gun drilling process is not required. Ports or passageways can also be formed between cavities 820 and 825 and recesses 830 and 835 to enable electrical connections between the sensors that will be placed in the cavities and the cables that will be installed in the recesses. Electrical connections between the sensors and cables may alternatively be made via lugs (e.g., 850, 855) in the cavities which are connected to the cables. Threaded holes 860 are provided to allow a clamping plate to be secured to the carrier to hold the sensors in place when they are installed in cavities 820 and 825.

Although the example embodiment described here has two cavities in which two corresponding sensors are installed, other embodiments may have more or fewer cavities and/or sensors. As with the embodiments described in connection with FIGS. 2-7, the carrier may have a single cavity if only a single sensor is needed, or it may have three (or more) cavities to house a corresponding number of sensors. Additionally, one or more of the sensor cavities may be left empty if the carrier has more cavities that the desired number of sensors.

Figure 9:
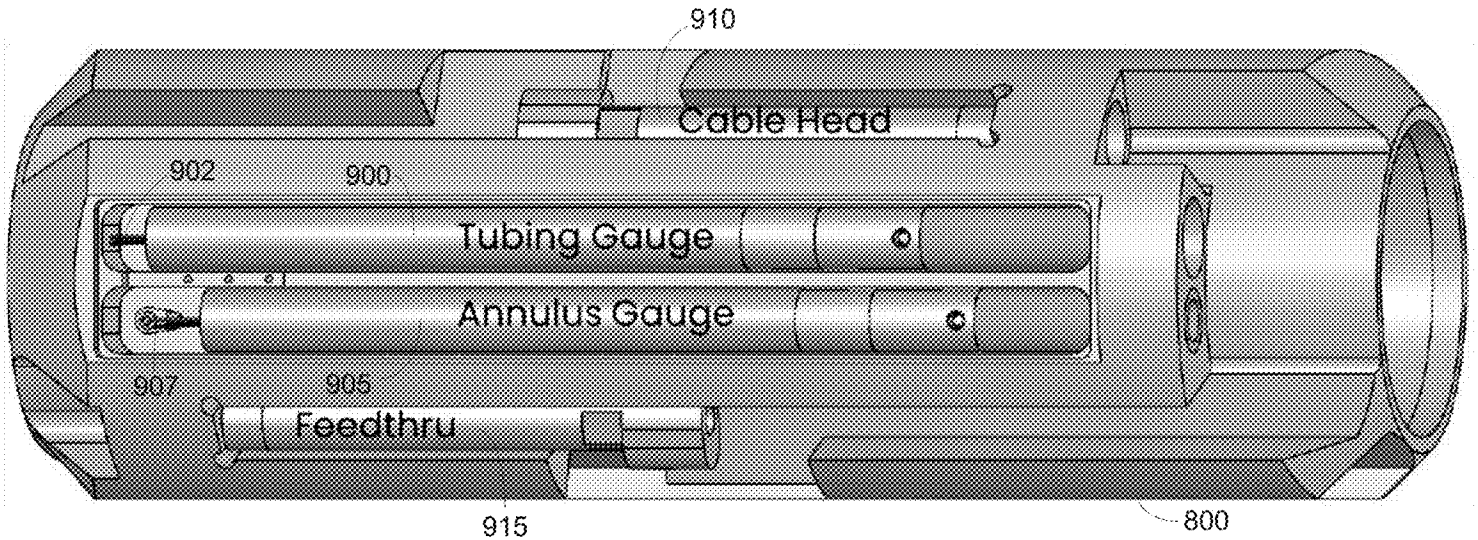
FIG. 9 is a diagram illustrating a gauge package with sensors, cable head and feedthrough installed in accordance with some embodiments.

Referring to FIG. 9, the carrier of FIG. 8 is shown with sensors, cable head and feedthrough installed. As depicted in this figure, two sensors are installed in carrier 800. A tubing gauge 900 is installed in cavity 820, and an annulus gauge is installed in cavity 825. Gauges 900 and 905 may be installed through the open side of the cavities, or they may be inserted into the cavities through the holes (840, 845) at the ends of the cavities. Electrical connections between the gauges and the cables or other electronics may be made by connecting the corresponding wiring (e.g., 902, 907) to the provided lugs or through the ports in the cavities. Power and communication cables (not shown in the figure) are connected to cable head 910 and feedthrough 915.

Figure 10:
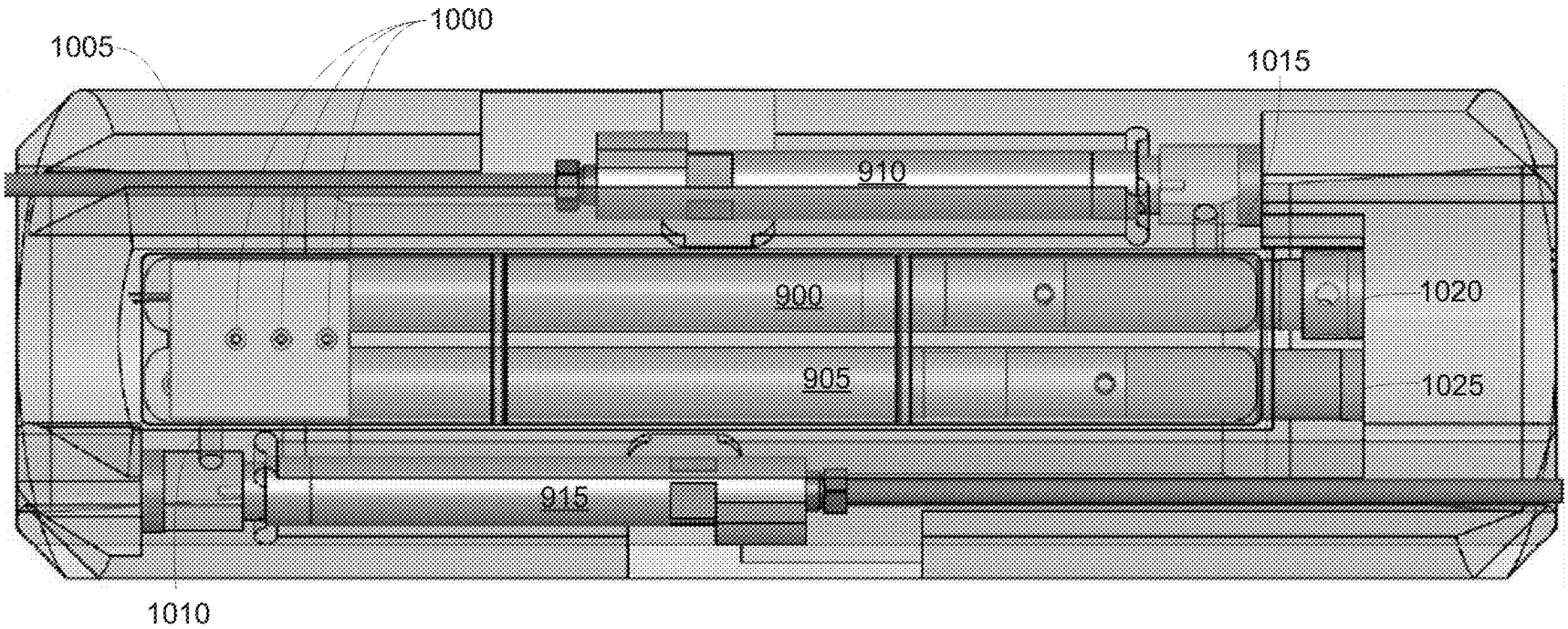
FIG. 10 is an alternative view of the carrier and sensors of FIG. 9.

Referring to FIG. 10, another view of the carrier and sensors of FIG. 9 is shown. In this figure, the carrier is depicted as transparent (with the outlines of the carrier shown) in order to provide a better view of sensors 900 and 905, cable head 910 and feedthrough 915. Also depicted in the figure is a clamp 1000 which is a plate that is installed over sensors 900 and 905 and is secured to carrier 800 by bolts 1005. A layer of cushioning material may be provided on clamp 1000 or between the sensors and the cavities' walls to cushion the sensors. Clamp 1000 holds sensors 900 and 905 securely against the carrier within cavities 820 and 825 (i.e., against interior walls of the cavities), reducing vibration and shock which can damage the sensors. The installation of clamp 1000 is enabled by the open side of cavities 820 and 825 and cannot be installed in carriers which have gun-drilled cavities that are open only on their ends and do not allow the interior of the cavities to be accessed for installation of such a clamp.

FIG. 10 also shows features such as passageways 1010 and 1015 through the carrier that connect cavities 820 and 825 with the recesses in which cable head 910 and feedthrough 915 are installed. FIG. 10 also shows pressure connections 1020 and 1025 which are installed at the ends of cavities 820 and 825 and allow pressure testing of the cavities after they are sealed. Also shown in the figure are electrical cables (which may tubing encased conductors, or TECs) that are coupled to the sensors through cable head 910 and feedthrough 915.

Figure 12:
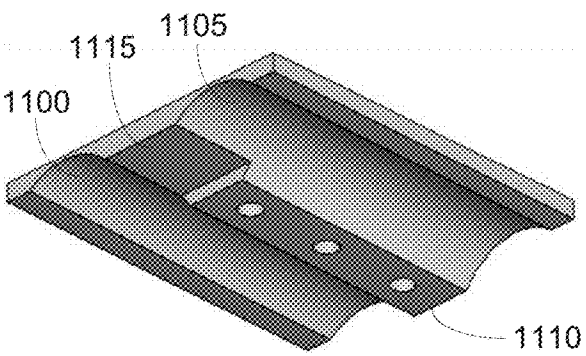
FIGS. 11 and 12 are diagrams illustrating a clamp used to secure sensors in a gauge package in accordance with some embodiments.
Figure 11:
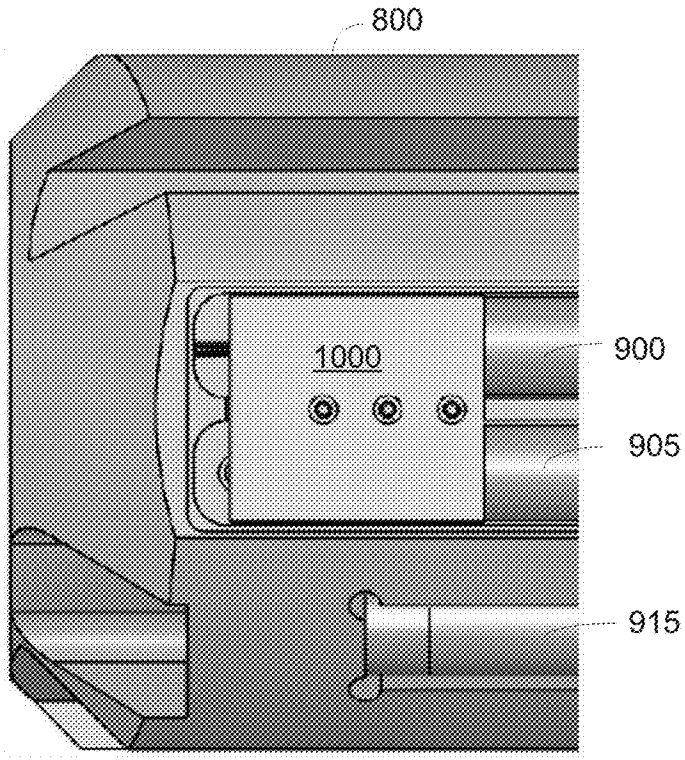

Referring to FIGS. 11 and 12, clamp 1000 is shown in more detail. FIG. 11 is an enlarged view of clamp 1000 installed over sensors 900 and 905. Clamp 1000 has two concave cylindrical surfaces 1100 and 1105 that are complementary to the outer surfaces of sensors 900 and 905. A central portion 1110 has a set of holes corresponding to threaded holes 860 of the carrier so that bolts extending through the holes can be used to secure clamp 1000 to the carrier to hold the sensors in place. A recess 1115 in the central portion 1110 provides space for wires to be routed between clamp 1000 and the portion of the carrier to which it is bolted.

Figure 14:
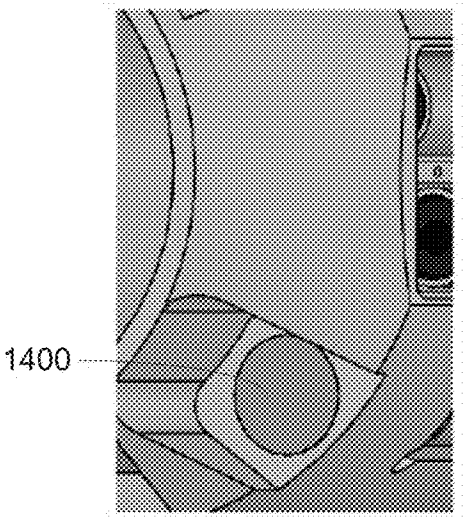
FIG. 14 is a figure showing a capped hole at the ends of the feedthrough recess in accordance with some embodiments.
Figure 13B:
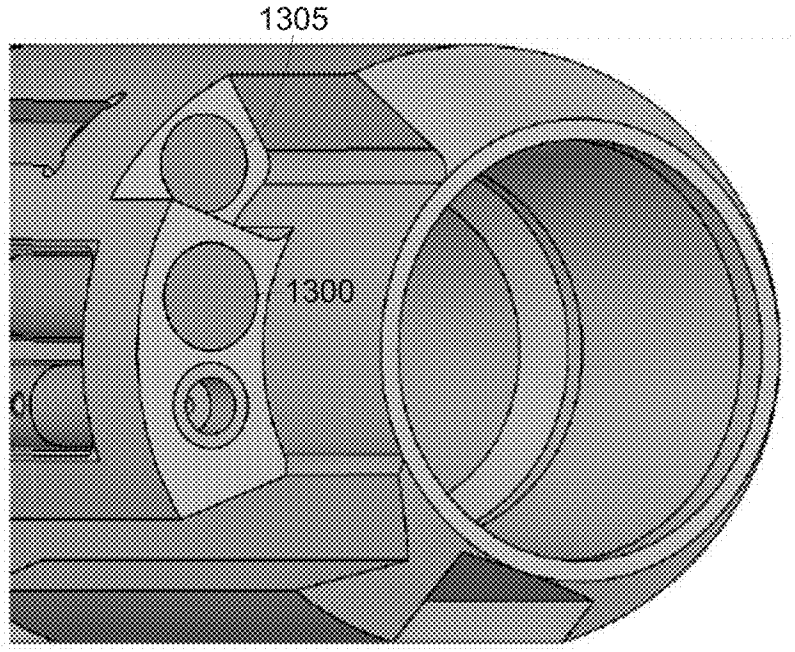
FIGS. 13A and 13B are a pair of figures showing holes at the ends of the sensor cavities and the cable head recess in accordance with some embodiments.
Figure 13A:
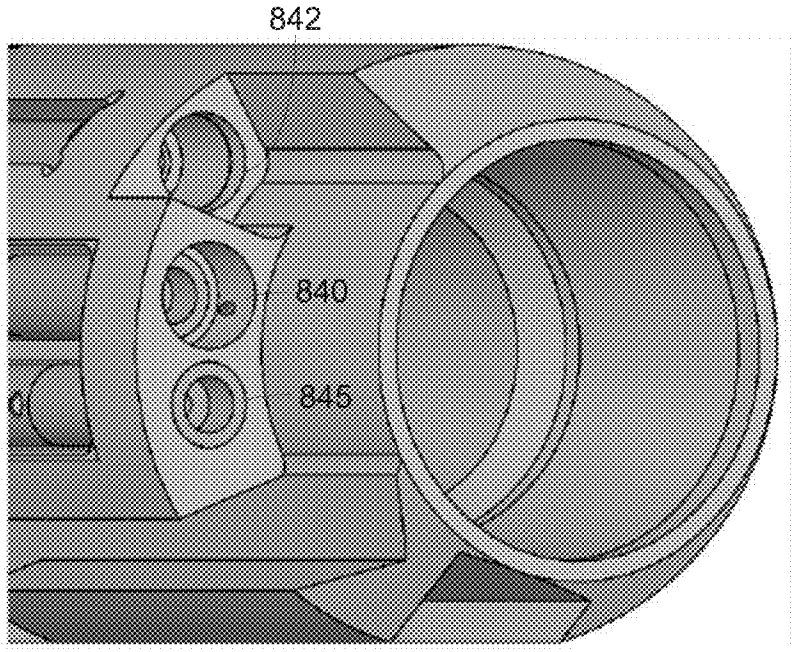

Referring to FIGS. 13A and 13B, a pair of figures showing holes 840, 842 and 845 at the ends of cavities 820 and 825 and cable head recess 830 are shown, before and after some of the holes have been sealed. As noted above, holes 840 and 845 may be formed in carrier 800 at the ends of cavities 820 and 825 to facilitate installation of sensors 900 and 905 in the cavities. After the sensors have been installed, hole 840 is sealed by welding a small cap 1300 over the end of the hole. Cavity 820 remains in fluid communication with the bore of the carrier via a corresponding passageway through the carrier. Hole 845 is not sealed shut, but pressure connection 1025 is positioned in the hole. This pressure connection seals cavity 825, but allows pressure testing of the cavity through the connection. Hole 842 at the end of cable head recess 830 is also sealed after installation of cable head 910 by welding a small cap 1305 over the end of the hole. Similarly, a cap 1400 is welded over the end of the hole at the end of feedthrough recess 835 after feedthrough 915 is installed in the carrier and connected to the sensors and/or cable, as shown in FIG. 14.

Figure 15:
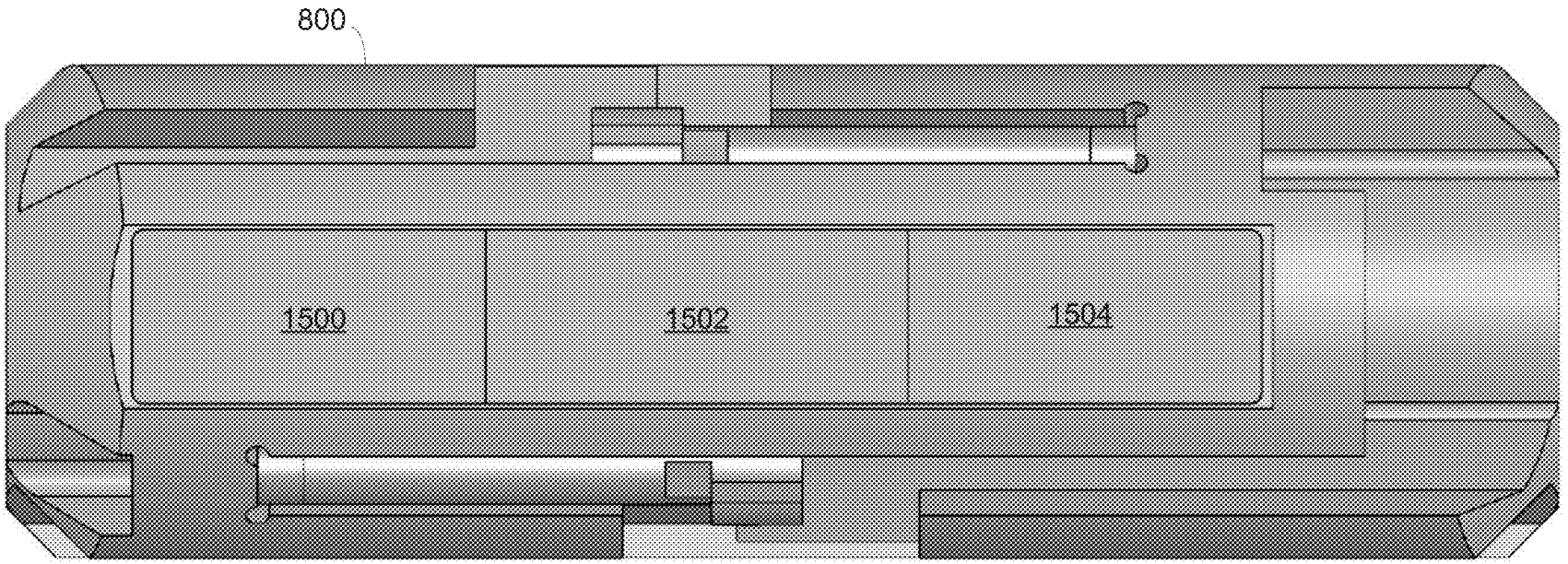
FIG. 15 is a figure illustrating a gauge package having a set of three plates that are installed to cover the side opening of the sensor cavities in accordance with some embodiments.

After the sensors, cable head and feedthrough have been installed in carrier 800, the open side of cavities 820 and 825 can be closed to seal the cavities. Referring to FIG. 15, a figure is shown to illustrate the use of one or more plates that are installed to cover the cavities. As depicted in the figure, three plates 1500, 1502 and 1504 are welded to carrier to seal the cavities. It is not necessary to use three plates, and in other embodiments, a different number of plate (e.g., a single plate) may be used. As noted above, the welding profile for this carrier is less complicated that the welding profile for the carrier of FIGS. 2-7, so this embodiment is less costly to manufacture.

Embodiments of the present invention may provide a number of advantages over existing designs. For example, as noted above, the use of a carrier having sensor cavities with a side opening eliminates the need to use expensive gun drilling processes to form the cavities, as is required for the embodiments of FIGS. 2-7. This reduces the cost of forming the cavities, as well as reducing the risk of having to scrap improperly manufactured carriers. Additionally, since the sensor cavities are open sided, there is much greater access to the sensors in the cavities making it easier to install the sensors, solder and splice wires, etc., which reduces the time and labor required to manufacture the couplings. Further, the open side access to the cavities allows a clamp to be installed to secure the sensors within the cavities, which reduces the vibration and shock to the sensors and increases their reliability. Still further, the weld profiles on the present embodiments are less complicated than those for carriers having gun drilled cavities, which reduces the time and cost to manufacture the devices.

With respect to conventional designs as shown in FIG. 1, the present embodiments may be substantially shorter than these designs (for example, an embodiment equivalent to a 40-inch long conventional carrier may be on the order of 12 inches long), which reduces the amount of material that is required for the carrier and reduces the corresponding material cost. Further, since the carrier wall itself forms a housing for each of the sensor packages, it is not necessary to provide separate sensor housings, which again reduces the amount of material and the cost of the apparatus. The present embodiments can use existing sensor and electronics components, and do not require specialized sensor designs. The present embodiments also eliminate the welding associated with the sensor package housings and has less leak path than in conventional designs. Still further, the present embodiments eliminate the need for manifold sealing kits that are necessary in conventional designs to seal the sensor package manifold against the carrier.

Still other benefits may be apparent to those skilled in the field of the invention.

The benefits and advantages which may be provided by the present invention have been described above with regard to specific embodiments. These benefits and advantages, and any elements or limitations that may cause them to occur or to become more pronounced are not to be construed as critical, required, or essential features of any or all of the embodiments. As used herein, the terms "comprises," "comprising," or any other variations thereof, are intended to be interpreted as non-exclusively including the elements or limitations which follow those terms. Accordingly, a system, method, or other embodiment that comprises a set of elements is not limited to only those elements, and may include other elements not expressly listed or inherent to the described embodiment.

While the present invention has been described with reference to particular embodiments, it should be understood that the embodiments are illustrative and that the scope of the invention is not limited to these embodiments. Many variations, modifications, additions and improvements to the embodiments described above are possible. It is contemplated that these variations, modifications, additions and improvements fall within the scope of the invention as detailed within the description herein.

What is claimed is:

1. An apparatus comprising:

a tubular sensor carrier having a first coupling at a first end of the carrier and a second coupling on a second end of the carrier opposite the first end;

a bore extending through the carrier from the first end to the second end, thereby forming a carrier wall between the bore and an exterior surface of the carrier, wherein the bore is offset from a central axis of the carrier, thereby creating an increased-thickness portion of the carrier wall on a first side of the carrier;

one or more cavities formed within the increased-thickness portion of the carrier wall, the one or more cavities each having an open side facing away from the bore; and one or more sensors positioned within corresponding ones of the one or more cavities;

one or more clamps which secure the one or more sensors within the one or more cavities against the carrier;

one or more side plates which are positioned to cover the entire open sides of the one or more cavities and are secured to the carrier so that the carrier and the one or more side plates form a housing that encloses the one or more sensors in the one or more cavities.

2. The apparatus of claim 1, wherein the one or more side plates are secured to the carrier by welding.

3. The apparatus of claim 2, wherein the welding seals the open side of each of the one or more cavities.

4. The apparatus of claim 1, further comprising a cable head and a feedthrough installed on the carrier, wherein at least one of the one or more sensors are electrically connected to the cable head and the feedthrough.

5. The apparatus of claim 4, further comprising one or more passageways through the carrier between the one or more cavities in which the cable head and feedthrough are installed, wherein electrical connections between the one or more sensors and the cable head and the feedthrough are routed through the one or more passageways.

6. The apparatus of claim 1, wherein at least one of the one or more cavities includes a port through which an interior of the at least one cavity is in fluid communication with an exterior of the carrier.

7. The apparatus of claim 1, wherein at least one of the one or more cavities includes a port through which an interior of the at least one cavity is in fluid communication with the bore through the carrier.

8. The apparatus of claim 1, wherein the one or more cavities are sealed except for ports through which an interior of the one or more cavities is in fluid communication with either the bore through the carrier an exterior of the carrier.

9. The apparatus of claim 1, further comprising one or more pressure connections installed in the carrier, wherein the one or more pressure connections enable pressure testing of the one or more cavities.

10. A method for manufacturing an instrumented downhole coupling, the method comprising:

forming a tubular carrier having a first coupling at a first end of the carrier and a second coupling on a second end of the carrier opposite the first end;

forming a bore which extends through the carrier from the first end to the second end, thereby forming a carrier wall between the bore and an exterior surface of the carrier, wherein the bore is offset from a central axis of the carrier, thereby creating an increased-thickness portion of the carrier wall on a first side of the carrier;

forming one or more cavities within the increased-thickness portion of the carrier wall, the cavities having a side opening facing away from the bore;

positioning one or more sensors in the one or more cavities;

accessing the one or more cavities through the side opening to make one or more electrical connections to the one or more sensors; and securing one or more plates over the entire side opening and sealing the one or more sensors in the one or more cavities, the plates and the carrier wall forming a housing that encloses each of the one or more sensors.

11. The method of claim 10, further comprising, prior to securing the one or more plates over the side opening, connecting a clamp to the carrier, wherein the clamp holds the one or more sensors against the carrier.

12. The method of claim 11, wherein connecting the clamp to the carrier comprises positioning a clamping plate over the one or more sensors and bolting the clamp to the carrier.

13. The method of claim 10, further comprising installing a cable head and a feedthrough on the carrier, each of the cable head and the feedthrough being connected to a corresponding electrical cable, wherein making the one or more electrical connections to the one or more sensors includes electrically connecting the one or more sensors to the one or more electrical connections at the cable head and the feedthrough.

14. The method of claim 10, wherein securing the one or more plates over the side opening comprises positioning the one or more plates over the side opening and welding the one or more plates to the carrier.

15. The method of claim 10, further comprising forming one or more passageways connecting one of the one or more cavities to the bore.

16. The method of claim 10, further comprising forming one or more passageways connecting one of the one or more cavities to an exterior of the carrier.

* * * * *